United States Patent [19]

Matsubara et al.

[11] Patent Number: 4,932,346

[45] Date of Patent: Jun. 12, 1990

[54] FEEDING CONTROL APPARATUS FOR A PLURALITY OF THREADS

[76] Inventors: Toru Matsubara; Minako Matsubara, both of 5-49-3 Fuda, Chofu-Shi, Tokyo, Japan

[21] Appl. No.: 298,545

[22] Filed: Jan. 18, 1989

[30] Foreign Application Priority Data

Jan. 21, 1988 [JP] Japan ..... 63-9695

[51] Int. Cl.[5] ..... D05B 47/04

[52] U.S. Cl. ..... 112/278; 112/163; 112/302

[58] Field of Search ..... 112/302, 278, 242, 254, 112/255, 241, 243, 244, 245, 250, 97, 80.72, 80.73, 163, 164, 165, 166, 167

[56] References Cited

U.S. PATENT DOCUMENTS

| | | | |
|---|---|---|---|
| 3,094,855 | 6/1963 | Vossen | 112/80.73 |
| 3,207,105 | 9/1965 | Card et al. | 112/80.72 |
| 4,018,171 | 4/1977 | Stone et al. | 112/80.72 |
| 4,215,641 | 8/1980 | Dobrjanskyj . | |
| 4,766,827 | 8/1988 | Matsubara . | |

FOREIGN PATENT DOCUMENTS

| | | | |
|---|---|---|---|
| 0247492 | 11/1986 | Japan | 112/302 |
| 61-247492 | 11/1986 | Japan . | |
| 61-279294 | 12/1986 | Japan . | |

*Primary Examiner*—Peter Nerbun

*Attorney, Agent, or Firm*—Armstrong, Nikaido, Marmelstein, Kubovcik & Murray

[57] ABSTRACT

Disclosed in a feeding control device for a plurality of threads in a sewing machine of the type wherein a set of a feed roller and a pressure roller are rotated forcibly at the same peripheral speed independently of the number of revolutions of a main drive shaft of the sewing machine so that a plurality of threads can be fed while the travel of each thread is controlled by each thread holding device. The present invention eliminates the necessity of securing high parallelism between both rollers to prevent their joint rotation, makes it possible to use a wear-resistant material for the pressure roller and can reduce breakage and damage of the thread due to friction with the rollers that are always rotating, at the time of stop of the thread.

1 Claim, 4 Drawing Sheets

(PRIOR ART) FIG. 7(b)

(PRIOR ART) FIG. 7(c)

FEEDING CONTROL APPARATUS FOR A PLURALITY OF THREADS

BACKGROUND OF THE INVENTION

1. Field of the Invention

This invention relates to a thread feeding device in a feeding control apparatus for a plurality of threads in a sewing machine. The apparatus supplies the threads consumed for forming stitches by thread feeding devices that are rotated forcedly without relying on the feeding operation of a thread take-up lever and uses the take-up lever only for the purpose of pulling the threads to tighten the stitch.

2. Description of the Prior Art

Since the present invention is primarily concerned with a thread feeding apparatus in a sewing machine using a plurality of threads arranged in such a manner that a necessary quantity of thread is fed out by a roller rotation feeding mechanism, the construction of a thread feeding mechanism in the sewing machine will be described first of all.

FIGS. 3 to 7 of the accompanying drawings show a sewing machine disclosed in Japanese Patent LaidOpen No. 279294/1986 and the thread feeding mechanism in this sewing machine will be described by way of example. FIG. 3 is a perspective view showing the sewing machine using a thread feeding control device by a roller, FIG. 4 is an explanatory view showing the construction of the thread feeding control device of FIG. 3, FIGS. 5(*a*) and 5(*b*) show an encoder mounted to a main drive shaft of the sewing machine, wherein 5(*a*) is a sectional side view and 5(*b*) is a front view of a slit disc, FIG. 6 is a sectional view of an electromagnetic thread holding device and FIGS. 7(*a*), (*b*) and (*c*) are diagrams showing the thread feeding control state, wherein 7(*a*) is an operation diagram of the electromagnetic thread holding device under the thread feeding state, 7(*b*) is its operation diagram under the high speed operation state of the sewing machine and 7(*c*) is its operation diagram under the low speed operation state of the sewing machine.

FIG. 3 is a perspective view showing a sewing machine A equipped with a thread feeding control device by a roller. As shown in FIG. 4, the sewing machine includes a needle 1, a thread take-up lever 2, a thread guide spring 3, thread guides 4, 5, 6, a thread holding device 7 on the side cf the thread take-up lever, a feed roller 8 equipped with an encoder which is driven by a motor rotating independently of the rotation of the main drive shaft of the sewing machine, a pressure roller 10 which is brought into or out of contact with or from the feed roller 8 by an electromagnetic controller 9, a thread holding device 11*a*, 11*b* on the thread feed side, a basic tension disc 12*a*, 12*b* and spools 13*a*, 13*b*. A rotary encoder 17 is fitted to the main drive shaft 16 equipped with a pulley 15 inside the sewing machine A. In the drawing, reference numerals 14*a*, 14*b* represent a thread and symbol B shows the portion of the thread feeding control device. The basic tension disc 12*a*, 12*b* need not always be contained in this portion.

The rotary encoder 17 is used to detect the end of the pulling operation of the thread to tighten the stitch by the thread take-up lever and a position sensor for the thread take-up lever used in a so-called "electronic sewing machine" can be used as this rotary encoder.

Tension is applied by the basic tension disc 12*a*, 12*b* to the thread 14*a*, 14*b* on the side of the spool 13*a*, 13*b* to such an extent as not to generate disturbance of the thread. The thread 14*a*, 14*b* is sent through the electromagnetic thread holding device 11*a*, 11*b* on the thread supply side which is under the inoperative state to the take-up lever side while being gripped between the feed roller 8 equipped with the motor driving encoder and the pressure roller 10. The feed control of the thread is effected in such a manner that the electromagnetic thread holding device 11*a*, 11*b* clamps the thread to stop its travel and to cause the slip of the thread over the feed roller 8 and the feed of the thread is thus stopped though the feed roller 8 keeps rotating. The electromagnetic controller 9 is disposed in order to release the pressing operation of the pressure roller 10 to the feed roller 8, whenever necessary.

As shown in FIGS. 7(*b*) and 7(*c*), the thread holding device 7 on the side of the take-up lever is equipped with the thread guide spring 3 in order to absorb the increase in the tension of the thread that occurs when the loop of the thread is passed around a rotating hook bobbin case holder by a rotating hook, when the thread passes between the rotating hook bobbin case holder and the tip of a rotation restraining finger or when the thread slips away from the tail of the rotating hook in addition to when the take-up lever pulls the thread to tighten the stitch. However, the thread guide spring may not be able to absorb the increase of tension in some structure or sewing conditions so that the tension acts on the thread which is being gripped and fed by the feed roller 8 and the pressure roller 10 and feeds the thread more than permitted by the rotation feeding operation of the feed roller 8. Accordingly, the thread is gripped at this time by the electromagnetic thread holding device 7 on the side of the thread take-up lever and any adverse influences on the thread feed action by the feed roller due to the change of tension are eliminated.

FIG. 5 shows an example of the rotary encoder 17 disposed inside the sewing machine. Photo cells 19 and 20 are disposed in a casing 18, through which the main drive shaft 16 penetrates, in such a manner as to face each other with a slit disc 21 between them. The end timing of the thread pulling operation by the thread take-up lever to tighten the stitch is detected by a signal from such an encoder to release the grip of the thread and to let the feed roller 8, equipped with a constant speed motor driving encoder, feed the thread.

FIG. 6 is a sectional view showing the structure of the electromagnetic thread holding devices 7 and 11*a*, 11*b*. A friction plate 25 is disposed on the upper surface of a coil spool 24 which comes into sliding contact with a cylindrical yoke 23 equipped with a magnet 22 and a cap 26 is disposed at the upper part of the yoke 23 so that the thread 14*a*, 14*b* can be gripped between the friction plate 25 and the back of the cap 26, and the feed operation of the thread by the feed roller 8 can be stopped. This operation can be made rapidly with hardly any inertia by passing a current through the coil spool.

Next, the operation of the thread feeding control device will be explained with reference to the diagrams shown in FIGS. 7(*a*), 7(*b*) and 7(*c*).

In the diagrams 7(*b*) and 7(*c*), symbol $T_1$ represents the timing of generation of the thread tension due to the thread pulling to tighten the stitch by the take-up lever, $T_2$ represents the upper dead-end of the take-up lever and $T_3$ represents the timing of disappearance of the thread tension. As shown in the diagram 7(*a*), the feed of the thread by the thread feed roller 8 equipped with the encoder driven by a motor rotating at a constant speed is made by detecting the timing P (which is at the same time as, or a little bit after, the timing $T_3$) by the signal from the rotary encoder 17 disposed on the main drive shaft of the sewing machine to release the grip of the thread by the electromagnetic thread holding device 11 on the thread supply side, then pushing the pressure roller 10 to the feed roller 8 to deliver the thread, operating again the electromagnetic thread holding device 11 at the time of completion (timing $T_4$) of the feed of the length l of the thread necessary for one stitch by the feed quantity detection encoder disposed coaxially so as to grip the thread and then stopping the thread feed operation by the thread feed roller 8.

The thread feed roller 8 equipped with the encoder is constructed in such a manner as to rotate at a constant speed although the rotating speed of the sewing machine can be changed. Therefore, the same quantity of the thread is fed within the same period of time. This means that the thread is always fed in the length l between P and Q as shown in the diagram 7(*a*) and the relationship between the positions of P, Q and the curve of the thread take-up lever changes as shown in the diagrams 7(*b*) and 7(*c*), respectively, at high and low speed operations of the sewing machine. Needless to say, the length l of the thread necessary for one stitch can be adjusted by changing the count number of pulses of the encoder but construction must be made so that the maximum quantity necessary for one stitch can also be supplied during the period from the tension disappearance timing $T_3$ to the next tension generation timing $T_1$ during the high speed operation of the sewing machine. However, if an attempt is made to secure the longest possible period in which the thread can be supplied, tension unavoidably develops when the thread passes between the rotating hook bobbin case holder and the tip of the rotation restraining finger and the thread feed control by the feed roller 8 might be disturbed. Accordingly, the thread is gripped by another electromagnetic thread holding device 7 disposed closer to the thread take-up lever than the feed roller 8 during such a tension generation period, that is, from near the lower dead-end of the thread take-up lever up to the generation of thread pulling tension to tighten the stitch by the take-up lever. In order to prevent any force from acting on the feed roller 8 during its feeding operation, the grip of the thread by the thread holding device 7 is released in the period after the end of the feed operation and before the start of the next thread pulling operation by the take-up lever to tighten the stitch so that the thread can be fed to the feed roller 8 by the take-up lever and at the same time, the thread pulling operation by the take-up lever to tighten the stitch can be carried out. Such a control signal can be obtained easily by the rotary encoder. In FIGS. 7(*b*) and 7(*c*), reference numeral 11M represents the operation zone of the electromagnetic thread holding device 11*a*, 11*b* on the thread supply side and 7M represents the operation zone of the electromagnetic thread holding device 7 on the thread take-up lever side. According to this arrangement, sewing can also be carried out with satisfactory stitches in the high speed operation of the sewing machine. It is obvious that if the supply of the thread can be made without any trouble in the high speed operation, the supply of the necessary length of the thread for one stitch can be made naturally without any trouble for the low speed operation as represented in the diagram 7(*c*) showing the low speed operation.

In the thread feed period of the sewing machine described above, the pressure roller 10 is driven by the thread feed roller 8 through the thread 14 as shown in FIGS. 8(*a*), 8(*b*). In the thread feed stop period wherein the thread is gripped by the thread holding device 11*a*, 11*b*, the feed roller 8 is rotating but the movement of the thread 14 is stopped and the pressure roller 10 stops rotating as well.

However, if a plurality of threads having different feed lengths are pressed and fed by one pressure roller, slip develops unavoidably between the threads and the pressure roller 10. If this slip develops, the pressure roller is worn out due to friction with the threads and forms grooves so that the thread pressing operation might not be effected. Therefore, a pressure roller must be disposed for each of the threads as shown in FIG. 8(*b*).

When a large number of threads are fed, an independent pressure roller must be disposed for each of these threads as described above. If the number of threads becomes large, the structure gets more complicated and the production becomes more difficult. Unless the axis of the pressure roller 10 is in parallel with that of the thread feed roller 8, the rollers might come into mutual contact while gripping the thread and if they do, the pressure roller 10 might rotate while carrying the feed roller 8 even under the state where the thread is under the stop state. In consequence, the force of friction acts between the thread under the stop state and the pressure roller 10 and groove-like wear scratches are formed on the pressure roller 10 having low wear resistance resulting in an insufficient thread pressing operation.

Since the pressure roller rotates with the movement of the thread, a material having large frictional force such as a resin is used for the roller, but is likely to be worn out. In addition, the pressure roller should not absolutely rotate with the feed roller as the result of it coming into contact therewith. Accordingly, machining accuracy must be improved to insure parallelism between the feed roller and the pressure roller but it is very difficult to keep such parallelism. Japanese Patent Application No. 066595/1987 therefore proposes an invention of a thread feeding device wherein two threads are gripped between the thread feed roller and the pressure roller in the spaced-part relation with each other.

Furthermore, if the pressing force of the pressure roller to the thread feed roller is increased, the portion of the pressure roller pressing the thread undergoes deformation so that there is a limit to the increase of the pressing force. Since the inertia of the pressure roller must be reduced because it rotates and stops synchronously with the movement and stop of the thread, it has been necessary to use a light-weight material for the pressure roller and to reduce its rotary torque by use of bearings or the like.

SUMMARY OF THE INVENTION

In order to eliminate the problems described above, the present invention employs the construction wherein the pressure roller is always rotated forcibly at the same peripheral speed as the feed roller so that a large number of threads can be fed by a set of a feed roller and a pressure roller. Thus the present invention makes it possible to increase the feed clamp force of the threads, to use a wear-resistant material for the pressure roller and to reduce necessity for securing accuracy of parallelism between the axes of both rollers.

Since the pressure roller is rotated forcibly at the same peripheral speed as the thread feed roller as described above, the threads can be fed out by one set of a feed roller and a pressure roller while the travel of the threads is controlled by individual thread holding devices. It is not necessary, in particular, to consider accuracy of parallelism between the axes of both rollers that has been necessary in the past to avoid the joint rotation of both rollers. When the thread is fed out, it is fed out by the frictional driving force in the vertical direction so that the feed-grip force of the thread can be increased. Accordingly, if a wear-resistant material is used for the pressure roller and its surface is finished to a mirror surface, any breakage of the thread due to friction between the roller, which is always rotating, and the thread at the time of stop of movement can be reduced.

The above and other objects and novel features of the present invention will become more apparent from the following description when taken in connection with the accompanying drawings.

DESCRIPTION OF THE PREFERRED EMBODIMENT

Figure 1:
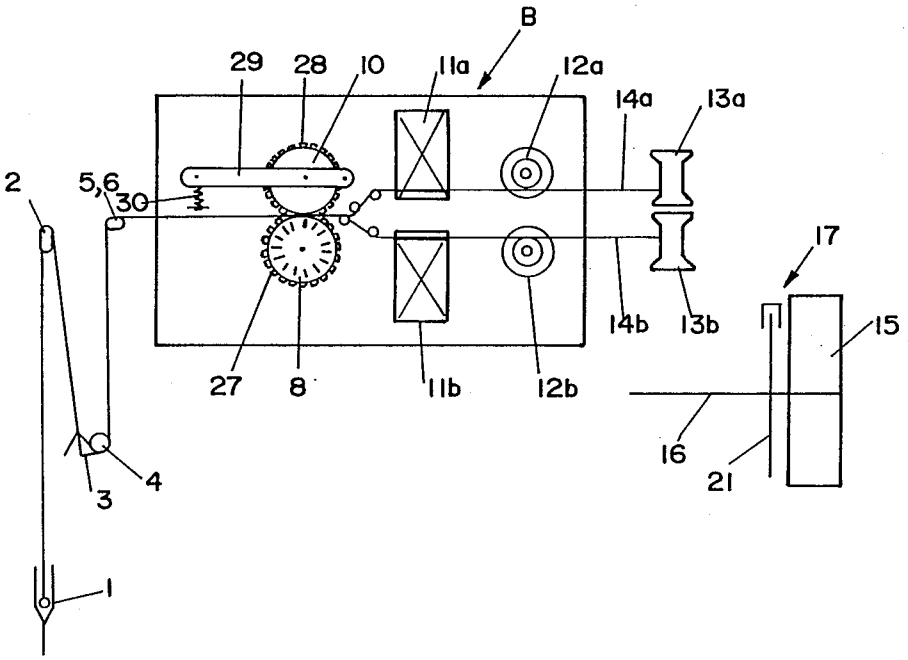
FIG. 1 is an explanatory view showing the construction of a thread feeding control device in accordance with the present invention.
Figure 4:
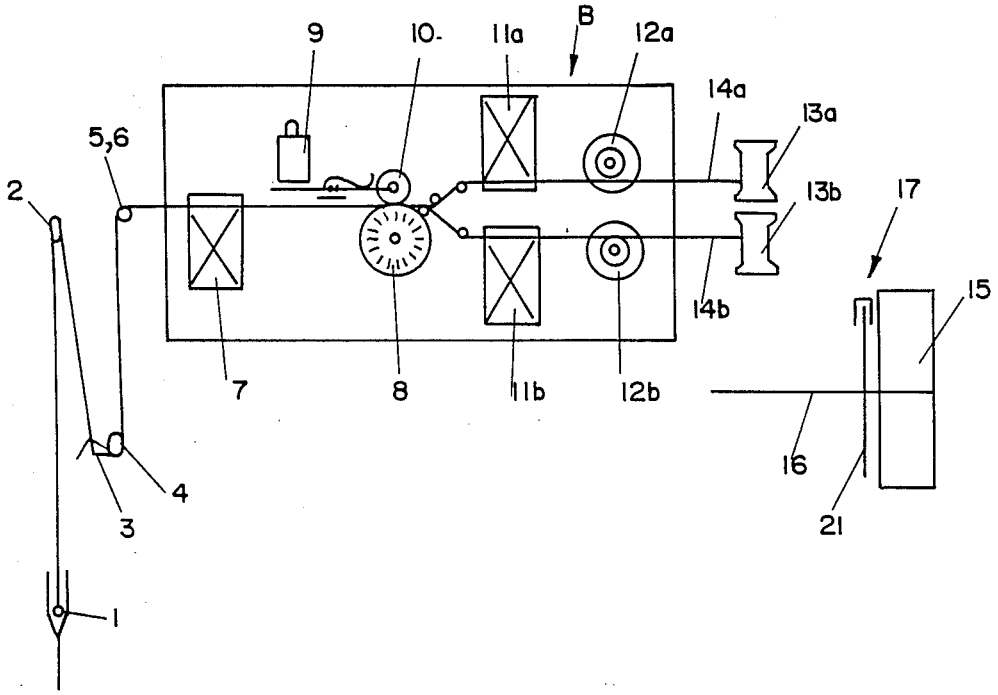
FIG. 4 (PRIOR ART)
FIG. 4 is an explanatory view showing the construction of a conventional thread feeding control device.
Figure 5A:
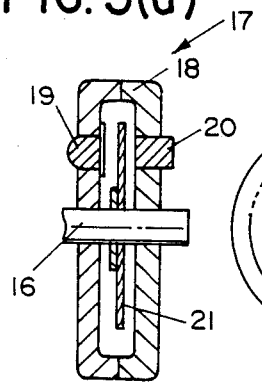
(PRIOR ART) FIG. 5(a)
FIGS. 5(*a*) and 5(*b*) show an encoder in the prior art fitted to a main drive shaft of the sewing machine, wherein (a) is a sectional side view and (b) is a front view of a slit disc.
Figure 5B:
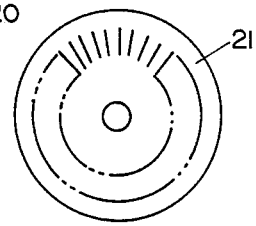
(PRIOR ART) FIG. 5(b)
Figure 6:
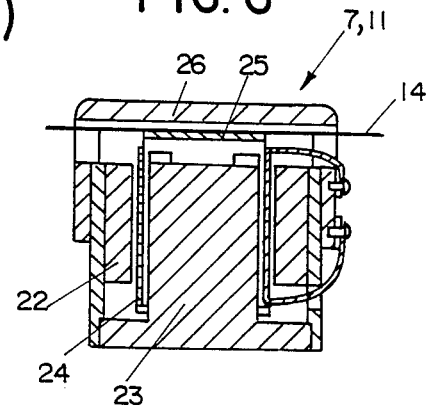
(PRIOR ART) FIG. 6
FIG. 6 is a sectional view of a conventional electromagnetic thread holding device.
Figure 7A:
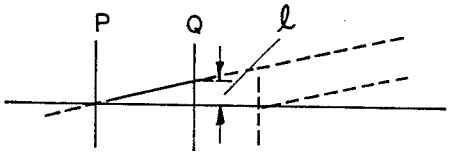
(PRIOR ART) FIG. 7(a)
FIGS. 7(*a*), 7(*b*) and 7(*c*) are diagrams each showing the conventional thread feeding control state, wherein (a) is an operation diagram of the thread holding device when the thread is fed out, and (b) and (c) are operation diagrams of the device under the high and low speed operation state of the sewing machine, respectively.
Figure 8A:
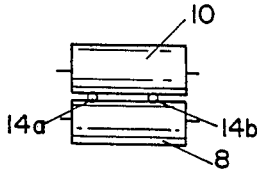
(PRIOR ART) FIG. 8(a)
FIG. 8(*a*) and 8(*b*) are a front view showing the construction of a thread feed roller and a pressure roller in a prior art example.
Figure 8A:
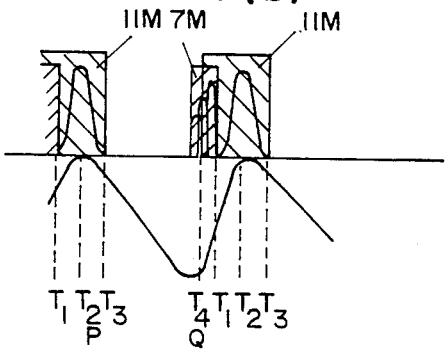
(PRIOR ART) FIG. 8(a)
Figure 8B:
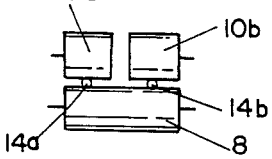
(PRIOR ART) FIG. 8(b)
Figure 8B:
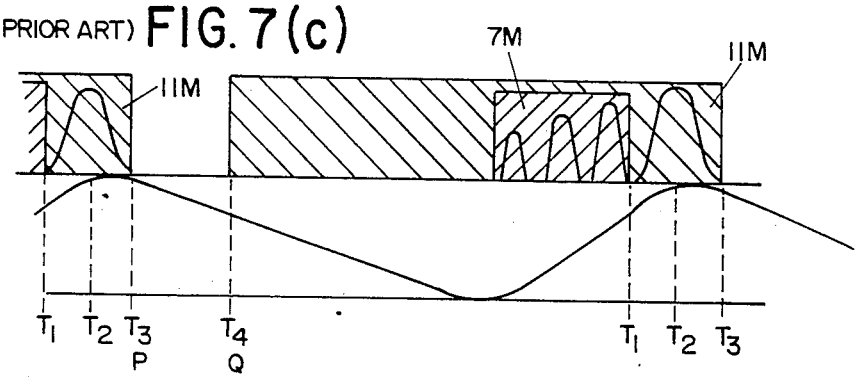
(PRIOR ART) FIG. 8(b)

FIG. 1 shows one embodiment of the present invention. Although the drawing shows control of only two threads, as many thread holding devices 11 as the number of threads are disposed but only one set of a feed roller and a pressure roller is used. This embodiment is different from the prior art example shown in FIG. 4 in the structure of the portion of the thread feed roller 8 and the pressure roller 10. As will be described later, an electromagnetic thread holding device 7 on the side of a thread take-up lever is omitted because it is not necessary.

Figure 2A:
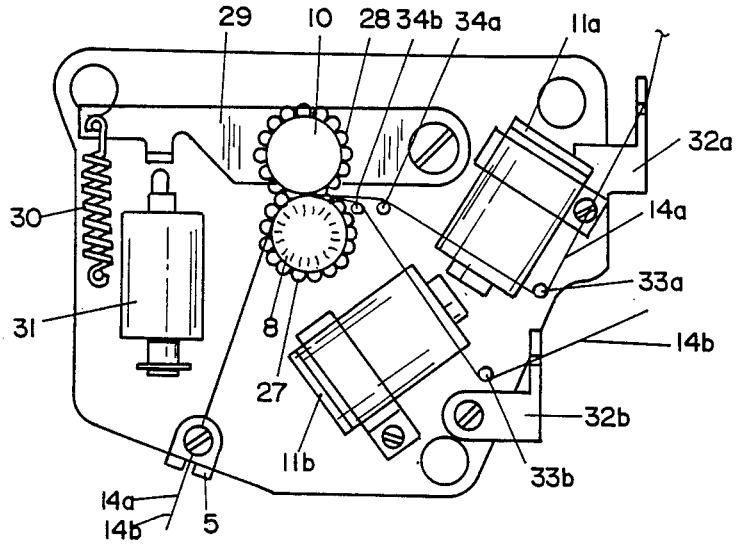
FIG. 2(*a*) is a plan view showing an embodiment of the feeding control device described above while FIG. 2(*b*) shows a side view of the gears of FIG. 2(*a*)
Figure 2B:
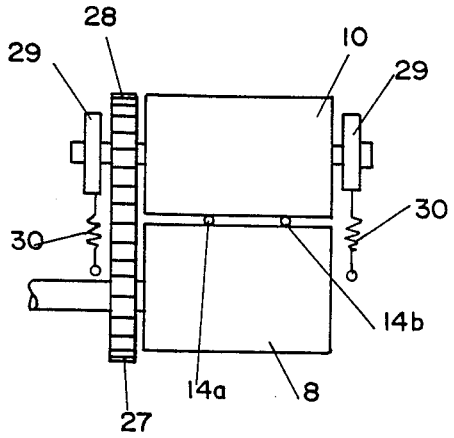
Figure 3:
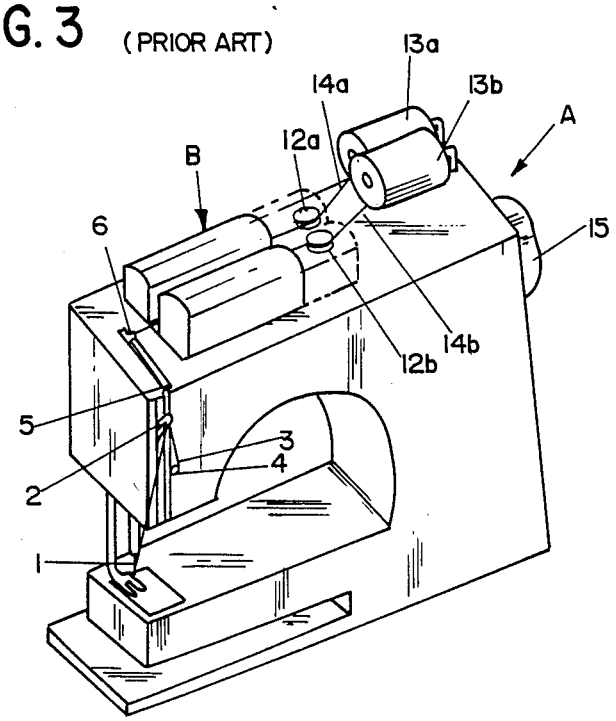
FIG. 3 (PRIOR ART)
FIG. 3 is a perspective view of a sewing machine using the thread feeding control device of the prior art.

In the present invention as shown in FIG. 2(*b*), gears 27 and 28 are fitted to the end portions of the thread feed roller 8 and pressure roller 10 so as to mesh with each other so that when the thread feed roller 8 is forcibly rotated, the pressure roller 10 is also driven by gear transmission. The number of teeth of these gears 27 and 28 is determined so that the peripheral speed of these rollers become equal to each other.

The axial distance between the thread feed roller 8 and the pressure roller 10 changes with the thickness of the thread clamped between them. Accordingly, both gears 27, 28 are arranged so that they can mesh with each other while capable of coping with such an axial displacement. There is no need to consider back-lash of gears because both gears are always rotated in the thread feeding direction, and it is possible to use the gears of the type which can rotate always at the same peripheral speed and in the same direction.

In another embodiment of the present invention, a chain or the like can be used in place of gear engagement because it is only necessary to rotate the feed roller 8 and the pressure roller 10 at the same peripheral speed. Furthermore, it is possible to use an independent synchronous motor for each of these rollers so as to rotate them at the same peripheral speed, and the encoder for measuring the feed quantity of the thread may be disposed on the side of the pressure roller.

FIG. 2(*a*) is a plan view showing a construction of the thread feeding control device in the present invention. Two threads are shown extended in the drawing and the gears 27 and 28 are fixed to the feed roller 8 and the pressure roller 10, respectively. The pressure roller 10 is supported by a lever 29 and is biased to the thread feed roller 8 by a spring 30. When pressing between the rollers must be released for threading or the like, the lever 29 is lifted up by an electromagnetic solenoid 31. Reference numerals 32*a*, 32*b*, 33*a*, 33*b*, 34*a* and 34*b* in the drawing represent guides of the thread. When a plurality of threads are used, the number of the electromagnetic thread holding devices 11 may be increased.

Needless to say, the construction described above can be applied to the case where the number of thread is only one.

In the present invention, the thread feed roller and the pressure roller are always rotated at the same peripheral speed during the sewing operation. As shown in FIG. 8(*a*), therefore, the feed quantities of two threads 14*a*, 14*b* may be different in the case of two threads in a multi-needle sewing machine such as an over-lock sewing machine or a flat-lock sewing machine and the rotation and stop of the pressure roller must be effected with the movement and stop of the threads. For this reason, it has been necessary in the prior art example to dispose independently the pressure rollers 10*a*, 10*b* in such a manner as to correspond to the threads 14*a*, 14*b*, respectively, as shown in 8(*b*) in place of the structure shown in 8(*a*). In accordance with the present invention, however, the thread feed roller and the pressure roller can be used in common because they are always rotated at the same peripheral speed, and the supply and stop of a large number of threads can be made by the mutually independent electromagnetic thread holding devices by using commonly the feed roller and the pressure roller. Furthermore, since the force to be applied between both rollers can be increased while gripping the thread between them, the thread can be fed out even when the surfaces of both the feed roller and pressure roller are finished to a mirror surface and possible damage to the thread at the stop of the thread feed can be reduced.

Furthermore, there is no particular need of taking into consideration the accuracy of parallelism between the axes of the feed roller and the pressure roller in order to prevent their joint rotation. This means that a relatively elongated roller can be used and the feed control of a large number of threads can be carried out by one set of rollers. When the threads are fed out, they are friction driven vertically while being gripped between the thread feed roller and the pressure roller. For this reason, the pressure roller can be made of a rigid steel material having low frictional force and even when its surface is finished to a mirror surface, the frictional force necessary for feeding the thread can be generated. Moreover, since the feed roller and the pressure roller are rotated at the same peripheral speed, no influences are exerted on the thread feeding operation even when their surfaces come into mutual contact. Accordingly, the contact pressure between both rollers can be increased and the thread grip force between them can therefore be increased (to the extent, of course, smaller than the grip force of the electromagnetic thread holding device 11). Even if the change of tension of the thread occurs such as when the loop of the thread is passed around the rotating hook bobbin case holder by the rotating hook, when the thread passes between the rotating hook bobbin case holder and the tip of the rotation restraining finger, or when the thread slips away from the tail of the rotating hook as described in Japanese Patent Laid-Open No. 279294/1986, the thread feed-grip force by the thread feed roller and the pressure roller can be increased beyond such a change. Therefore, the electromagnetic thread holding device 7 on the side of the take-up lever side may be omitted because no influences are exerted on the thread feeding operation.

Although the present invention has thus been described in its preferred forms, it will be obvious to those skilled in the art that various changes and modifications can be made without departing from the scope and spirt of the appended claim.

What is claimed is:

1. A feeding control device for a plurality of threads in a sewing machine, said feeding control device comprising:

a sensor for sensing an end timing of a pulling operation of threads by a thread take-up lever to tighten a stitch, said sensor disposed in said sewing machine;

a pressure roller disposed in said sewing machine;

a thread feed roller equipped with an encoder, said thread feed roller disposed in said sewing machine and constantly rotating independently of the number of revolutions of a main drive shaft of said sewing machine in cooperation with said pressure roller while gripping a plurality of threads;

a plurality of electromagnetic thread holding devices, each being disposed on a thread feed side of said thread feed roller and dedicated to each of said threads, releasing a grip of said thread by a signal from said sensor, feeding said thread as much length as necessary for one stitch using said thread feed roller, sensing an end of a feed operation thereof by a signal from said encoder of said thread feed roller and again gripping said thread; and interconnection driving means for ensuring constant rotation of said pressure roller and said thread feed roller at a same peripheral speed, said interconnecting driving means being disposed between said pressure roller and said thread feed roller.

* * * * *